United States Patent [19]

Panaro et al.

[11] 4,219,795

[45] Aug. 26, 1980

[54] FUSIBLE ELEMENT FOR TIME-LAG FUSES HAVING CURRENT-LIMITING ACTION

[75] Inventors: Robert J. Panaro, Byfield; Philip C. Jacobs, Jr., Newtonville, both of Mass.

[73] Assignee: Gould Inc., Rolling Meadows, Ill.

[21] Appl. No.: 952,383

[22] Filed: Oct. 18, 1978

[51] Int. Cl.[2] ..... H01H 00/00

[52] U.S. Cl. ..... 337/296; 337/163; 337/295

[58] Field of Search ..... 337/163, 164, 166, 160, 337/159, 158, 296, 295

[56] References Cited

U.S. PATENT DOCUMENTS

| | | | |
|---|---|---|---|
| 3,261,950 | 7/1966 | Kozacka | 337/163 |
| 3,291,943 | 12/1966 | Kozacka | 337/163 |
| 3,341,674 | 9/1967 | Jacobs, Jr. | 337/164 |
| 3,935,553 | 1/1976 | Kozacka et al. | 337/160 |

*Primary Examiner*—Harold Broome
*Attorney, Agent, or Firm*—Erwin Salzer

[57] ABSTRACT

A fusible element for electric fuses combining considerable time lag with current-limiting action. Time lag is achieved by providing the fuse with a combination of a plurality of means for achieving this end, such as folding the perforated center portion of the fusible element twice in a direction longitudinally thereof to achieve mutual heating of the folded portion, providing the center portion with end portions or heat dams of reduced cross-section which limit the flow of heat from the center portion to the terminals of the fuse, and are folded in transverse direction, and providing the fusible element with means capable of severing the fusible element by a metallurgical reaction, widely known as M-effect. The M-effect means increase time lag because of their mass and because they derate the fusible element. They cause severing of the center portion of the fusible element and are heated, in addition to $i^2 \cdot r$ losses occurring in the center portion of the fusible element, by convection, conduction and radiation across a gap formed between the center portion of the fusible element and a section of one of the end portions of the fusible element.

In the interest of economy only the perforated center portion of the fusible element is of silver having a fusing $i^2 \cdot t$ of $8.00 \cdot 10^8$ $(amp/cm^2)^2 \cdot sec.$, while the end portions are of a metal other than silver, such as copper, which has a fusing $i^2 \cdot t$ of 11.72 $(amp/cm^2)^2 \cdot sec.$

4 Claims, 4 Drawing Figures

FUSIBLE ELEMENT FOR TIME-LAG FUSES HAVING CURRENT-LIMITING ACTION

RELATED PATENTS

The closest prior art we are familiar with is U.S. Pat. No. 3,291,943; Dec. 13, 1966 to F. J. Kozacka for TIME-LAG FUSE WITH RIBBON FUSE LINK FOLDED IN LONGITUDINAL AND TRANSVERSE DIRECTION.

BACKGROUND OF THE INVENTION

This invention relates to fusible elements for electric fuses, in particular time-lag or time-delay fuses.

There are many methods to delay blowing of electric fuses at relatively high inrush currents of short duration. One of these methods consists in effecting mutual heating of different surfaces of a fusible element. For instance, the perforated center portion of a fusible element having a relatively low fusing $i^2 \cdot t$ value, e.g. silver or copper, may be folded longitudinally to form a plurality of longitudinal edges. The surfaces to different sides of these edges have a mutual heating effect upon each other.

Another method to achieve time-lag in an electric fuse is to place a metal-serving element having a fusing point less than the fusing point of the base metal on which it is affixed, e.g. silver or copper, at the location where the highest temperature of the metal prevails. This effects a derating of the fuse and a concomitant increase of its time lag.

Still another method to achieve time-lag is to increase the temperature of the center portion of the fusible element of the fuse either by thermally insulating the latter from the terminal elements by so-called heat dams, or by converting such heat dams into generators of heat by imparting a sufficiently high resistance to them.

The invention is predicated on a combination of the aforementioned methods.

A particular object of this invention is to meet a certain U.L. Standard by a fusible element that is predicated on the application of a metal severing element, or overlay, having a fusing point lower than the fusing point of the base metal by which the metal severing element is supported, or which supports the overlay. Fuses whose fusible elements are severed in a certain current range by a metal diffusion process are known as M-effect fuses, and this invention refers to M-effect fuses.

The above referred-to U.L. Standard requires that a time-lag fuse must fuse, or blow, within 1 hour at currents equal to 135% of their respective current rating. This requirement causes difficulties, particularly if the fusible element is relatively short, such as in fuses rated 30 amps. at 250 volts, because under the conditions specified by this U.L. Standard the temperature to cause the M-effect to occur can hardly be reached. Substitution of a high specific resistance metal such as bronze for a low specific resistance metal such as silver or copper, results in unacceptably high current-carrying temperatures of the fuse and in metal masses of the fusible element which fuse too slowly under short-circuit conditions, and which evolve too large amounts of metal vapors ro be acceptable.

There are many M-effect fusible elements known in the art which comply with the above U.L. Standard, but these fusible elements are complex and of one single metal and this single metal must be silver if compliance of the above U.L. Standard is to be coupled with small peak let-through currents. It is, therefore, a further object of this invention to provide fusible elements for time-lag fuses that comply with the above U.L. Standard, do not run too hot, are capable of effectively interrupting high short-circuit currents and whose current path comprises a plurality of different serially related metals.

Another object of the invention is to provide time-lag fuses that are current-limiting under short-circuit conditions and that include particular means for derating the fuses by mutual heating of sections of the fusible element thereof, as will become more apparent as this specification proceeds.

SUMMARY OF THE INVENTION

According to this invention a fusible element for electric fuses includes a perforated center portion of a metal having a relatively low fusing $i^2 \cdot t$ value, said center portion having a relatively large width and being folded in a direction longitudinally thereof to form a plurality of longitudinal edges. Said perforated center portion has affixed to each of the ends thereof non-perforated and portions of a metal having a relatively high fusing $i^2 \cdot t$ value. Each of said end portions has a relatively small width and is folded along two transverse lines in such a way that a section of each of said end portions overlaps relatively closely a section of said center portion, but leaves a gap between said center portion and said section of each of said end portions. A metal-severing element having a fusing point lower than the fusing point of the metal of said center portion affixed to said center portion at said section thereof that overlaps one of said sections of one of said end portions of that said metal-severing element, in addition to being directly heated by $i^2 \cdot r$ losses therein, is also heated by convection, conduction and radiation occurring across said gap between said center portion and said section of one of said end portions.

DESCRIPTION OF PREFERRED EMBODIMENT

Figure 3:
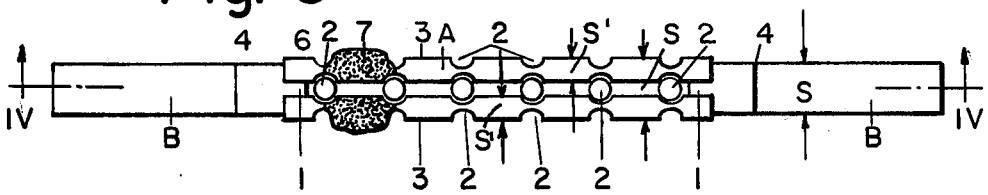
FIG. 3 is a top-plan view of the fusible element shown in FIG. 1.
Figure 4:
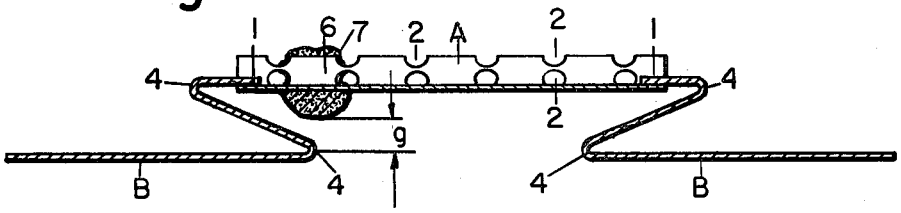
FIG. 4 is a longitudinal section of the fusible element of FIG. 1 along IV—IV of FIG. 3.

The drawing shows a fusible element intended to conductively interconnect the terminal elements of a fuse. The fusible element includes a perforated center portion A and non-perforated end portions B. The center portion A is of a metal having a relatively low fusing $i^2 \cdot t$ value, while the end portions B are of a metal having a relatively high fusing $i^2 \cdot t$ value. Spot welds situated at points designated by reference numeral 1 establish conductive connections between center portion A and end portions B. The center portion A is relatively wide while the end portions B are relatively narrow. Center portion A is substantially channel-shaped, or made of a sheet metal that is bent or folded into substantially channel-shaped form, and provided with perforations 2. The entire width of center portion A comprises—as best shown in FIG. 3—the width S of its base and twice the width S' of its flanges. Hence the total width of center portion A is S+2S'. The end portions B are inserted into the ends of channel-shaped center portion A before being spot-welded to it. The width of end portions B is approximately S. While the center portion A is folded in a longitudinal direction along edges 3, the end portions B are folded each along two transverse lines 4. This is done in such a way that a section 5 of each end of end portions B overlaps relatively closely a section 6 of center portion A.

Reference character 7 has been applied to indicate a metal-severing element, or M-effect element, having a lower fusing point than the fusing point of the metal of which center portion A is made. Metal-severing element 7 is affixed to center portion A, and more particularly to left section 6 thereof that overlaps section 5 of left end portion B. As a result of this arrangement of parts, metal-severing element 7, in addition to being directly heated by $i^2 \cdot r$ losses in center portion A, is also heated by convection, conduction and radiation occurring across the gap g between metal severing element 7 and section 5 of the left end portion B.

Portion A may be of silver and end portions B of a metal other than silver and having a fusing $i^2 \cdot t$ value higher than the fusing $i^2 \cdot t$ value of silver, e.g. copper.

Center portion A may also be of copper and end portions B of a metal other than copper, and having a higher fusing $i^2 \cdot t$ value than copper. The specific resistance of the metal of which said one end portion is made should by far exceed the specific resistance of the metal of which said other end portion is made. Assuming center portion A is of copper, then the left end portion B which greatly contributes to the heating of M-effect element 7 may be made of bronze, while right end portion B may be made of copper.

Figure 1:
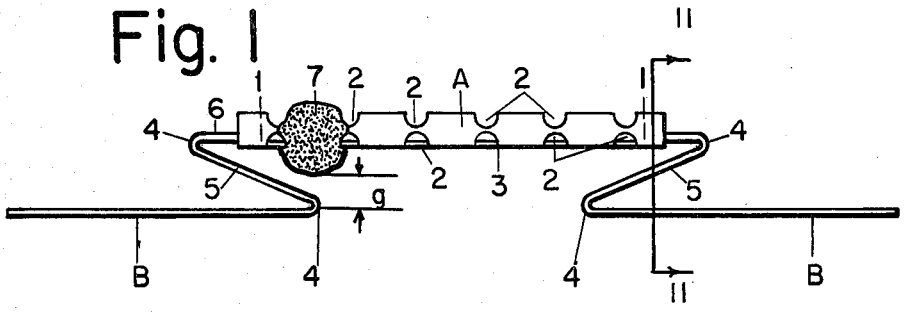
FIG. 1 is an elevation of a fusible element embodying the present invention.
Figure 2:
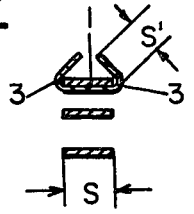
FIG. 2 is a cross-section along II—II of FIG. 1.

The fuse element structure of FIG. 1 having a perforated center portion A of silver is capable of complying with the above U.L. Standard and at the same time minimizing the fusing $i^2 \cdot t$ of the fusible element. The fact that only the perforated center portion A of the fusible element is of silver, while its end portions B are of a metal other than silver, greatly reduces the material cost of the fusible element.

If the center portion A is of copper and one of the end portions B of a metal other than copper and having a higher fusing $i^2 \cdot t$ value than copper and a specific resistance by far exceeding that of copper, such a fusible element will comply with the above U.L. Standard because one of the end portions operates as a heat dam precluding escape of heat from center portion A, and as a heater or heat generator. At the same time a center portion of copper assumes a relatively low let-through current peak because the fusing $i^2 \cdot t$ value of copper is next to that of silver. The other of the two end portions B is not required to operate as a heater for M-effect element 7, and thus may consist of copper, as center portion A.

The best performing combination of metals is silver for the center portion A, copper for one of the end portions B, and a metal having a higher specific resistance than copper for the other of end portions B, to serve as a heater for M-effect element 7.

In the drawing the mass of solder involved in M-effect element 7 has been exaggerated for reasons of greater clarity. In fact the M-effect element 7 may be quite small because it coats the region thereof situated between adjacent perforations, including the points of minimum cross-section of center portion A situated between contiguous perforations. Thus the link-severing process is initiated at points where the cross-sectional area of center portion A is minimized.

The end portions B are conductively connected at the axially outer ends thereof to the terminal elements or terminal caps of the fuse. How this is done is disclosed in greater detail in the patent application of Robert J. Panaro, filed Aug. 8, 1978, Ser. No. 932,020 for ELECTRIC FUSE HAVING FOLDED FUSIBLE ELEMENT AND HEAT DAMS. See also the above referred-to U.S. Pat. No. 3,291,943 to F. J. Kozacka.

We claim as our invention:

1. A fusible element for an electric fuse including (a) a perforated center portion of a metal having a relatively low fusing $i^2 \cdot t$ value, said center portion having a relatively large width and being folded in a direction longitudinally thereof to form a plurality of longitudinal edges;

(b) non-perforated end portions of a metal having a relatively high fusing $i^2 \cdot t$ value arranged on each end of said center portion, each of said end portions having a relatively small width and being folded along two transverse lines in such a way that a section of each of said end portions overlaps relatively closely a section of said center portion, but does leave a gap between said center portion and said section of each of said end portions; and (c) a metal-severing element having a fusing point lower than the fusing point of the metal of said center portion, said metal-severing element being affixed to said center portion at said section thereof that overlaps said section of one of said end portions so that said metal-severing element, in addition to being directly heated by $i^2 \cdot r$ losses in said center portion, is also heated by convection, conduction and radiation occurring across said gap between said center portion and said section of one of said end portions.

2. A fusible element as specified in claim 1 wherein said center portion is of silver, and said end portions for a metal other than silver and having a fusing $i^2 \cdot t$ value higher than the fusing $i^2 \cdot t$ value of silver.

3. A fusible element as specified in claim 1 wherein said center portion is of copper, one of said end portions is of a metal other than copper and having a higher fusing $i^2 \cdot t$ value than copper, and wherein the specific resistance of the metal of said one of said end portions by far exceeds the specific resistance of the metal of the other of said end portions.

4. A fusible element as specified in claim 1 wherein said center portion is of silver, one of said end portions of copper, the other of said end portions of a metal having a higher specific resistance than copper, and wherein said metal-severing element is arranged adjacent the end of said center portion where said end portion of a metal having a higher specific resistance than copper is located.

* * * * *